US005576056A

United States Patent [19]

Roe

[11] Patent Number: 5,576,056

[45] Date of Patent: Nov. 19, 1996

[54] COMPOSITION AND METHOD FOR INHIBITING COAL OXIDATION

[75] Inventor: Donald C. Roe, Burlington, N.J.

[73] Assignee: BetzDearborn Inc., Trevose, Pa.

[21] Appl. No.: 376,317

[22] Filed: Jan. 20, 1995

[51] Int. Cl.[6] ..... B05D 7/00

[52] U.S. Cl. ..... 427/221; 427/212; 427/244; 252/70; 106/13

[58] Field of Search ..... 252/70, 88; 427/212, 427/221, 244; 106/13

[56] References Cited

U.S. PATENT DOCUMENTS

| | | | |
|---|---|---|---|
| 4,400,220 | 8/1983 | Cole, Jr. | 134/18 |
| 4,426,409 | 1/1984 | Roe | 427/221 |
| 4,551,261 | 11/1985 | Salihar | 252/88 |
| 4,666,741 | 5/1987 | Roe | 427/220 |
| 4,780,143 | 10/1988 | Roe | 106/102 |
| 4,780,233 | 10/1988 | Roe | 252/88 |
| 4,797,136 | 1/1989 | Siddoway et al. | 44/501 |
| 4,897,218 | 1/1990 | Roe | 252/313.1 |
| 5,079,036 | 1/1992 | Roe et al. | 427/212 |
| 5,128,178 | 7/1992 | Roe | 427/244 |
| 5,143,645 | 9/1992 | Roe | 252/313.1 |
| 5,256,169 | 10/1993 | Roe | 44/626 |
| 5,256,444 | 10/1993 | Roe | 427/136 |

OTHER PUBLICATIONS

"The Inhibition of Coal Oxidation and Self Heating by Commercial Dust Suppressants", by N. T. Moxon and S. B. Richardson, Coal Preparation, 1987, vol. 4, pp. 183–191.

"The Self Heating of Coal and Its Chemical Inhibiton", N. T. Moxon and S. B. Richardson, Third Australian Coal Preparation Conference, 1985, Wollongong, Australia, pp. 138–153.

"A Model for the Spontaneous Heating of Coal", Schmall et al., Fuel, 1985, vol. 64, Jul., pp. 963–972.

"Polyamine and Polyquaternary Ammonium Salts", The Encyclopedia of Polymer Science and Engineering, vol. 11, sec. ed. 1988, pp. 489–507.

*Primary Examiner*—Nathan M. Nutter
*Assistant Examiner*—Duc Truong
*Attorney, Agent, or Firm*—Alexander D. Ricci; Matthew W. Smith

[57] ABSTRACT

Compositions and a method for inhibiting coal oxidation. Coal oxidation is inhibited by applying an aqueous solution of cationic polymer to coal surfaces which are exposed to air. The compositions are preferably applied to coal as foams.

9 Claims, 3 Drawing Sheets

COMPOSITION AND METHOD FOR INHIBITING COAL OXIDATION

FIELD OF THE INVENTION

The present invention relates to inhibition of coal oxidation. More particularly, the present invention relates to coal oxidation inhibiting compositions comprising aqueous solutions of water soluble cationic polymers and to a method for using the compositions for inhibiting coal oxidation.

BACKGROUND OF THE INVENTION

Coal is a naturally occurring solid material comprised of mostly amorphous elemental carbon with low percentages of hydrocarbons, complex organic compounds and inorganic material. Coal is used in bulk as both a source of raw chemical materials and as a fuel. Coal is typically utilized in the form of chunks which vary in size from softball size lumps to fine powder granules and is stored either outdoors or in covered areas near the location where the coal will be ultimately used.

When coal is exposed to air, the amorphous elemental carbon slowly oxidizes to form $CO_2$ and heat. Oxidation is accelerated in the presence of moisture and elevated temperature. Oxidation is a detrimental process since it reduces the caloric heating value of coal and can cause spontaneous combustion, or coal self-ignition. Additionally, in some instances where coal self-ignition occurs in the presence of airborne coal dust, coal dust explosions can also occur. Coal has traditionally been stored in compacted piles to reduce the intrusion of air and moisture and to thereby mitigate the oxidation process. Piling does not halt coal oxidation but is merely an attempt to slow the oxidation rate. The ideal coal pile is large enough to reduce the surface area of the coal which is exposed to air, yet small enough that heat generated within the coal pile is dissipated into the surrounding environment. Unfortunately, in large coal handling facilities, such as but not limited to coal fueled power plants, the large quantity of coal utilized makes ideal conditions difficult to achieve and incidents of coal self-ignition resulting from coal oxidation are common occurrences. Coal fires and coal dust explosions pose serious dangers to personnel and are costly in terms of damaged equipment and consumed coal. Thus a need exists for a composition and a method for using the composition which inhibits coal oxidation to preserve the caloric heating value of coal and to inhibit coal self-ignition.

It is an object of this invention to provide a composition and a method of using the composition which inhibits the oxidation of coal and thereby also inhibits coal self-ignition and preserves the caloric heating value of coal.

PRIOR ART

U.S. Pat.Nos. 5,128,178 and 5,256,444 both to Donald C. Roe, disclose methods and compositions for controlling fugitive dust emissions from bulk granular or powdered solids including coal. Fugitive dust emissions are controlled by applying an aqueous, foamed solution including a water-soluble cationic polymer to dust producing, bulk, granular or powdered solids. The cationic polymer is incorporated into an aqueous foam comprising anionic, amphoteric or cationic foaming agents.

U.S. Pat. Nos. 4,426,409 to William J. Roe discloses a composition and a method for treating particles such as minerals and coal having surface moisture to reduce the cohesive strength of the particles when frozen. The composition comprises a dilute aqueous solution which contains water soluble cationic polymer and a freezing point depressant amount of an anti-freeze chemical. The method comprises spraying the particles, prior to freezing, with the composition.

N.T. Moxon and S.B. Richardson in "The Self Heating of Coal and It's Chemical Inhibition" Third Australian Coal Preparation Conference, 1985 and in "Coal Preparation", 1987, Vol. 4 pp. 183–191 disclose the ability of some commonly used dust suppressants to inhibit coal oxidation. An agglomerating agent, a wetting agent and a polymer dispersant were tested and were found to inhibit the coal oxidation process with emulsified oil type agglomerating agents exhibiting the greatest inhibiting effect of the materials tested.

BRIEF DESCRIPTION OF THE DRAWINGS

The appended drawings graphically present the data generated by the examples which are reported herein below. In the drawings.

SUMMARY OF THE INVENTION

Figure 1:
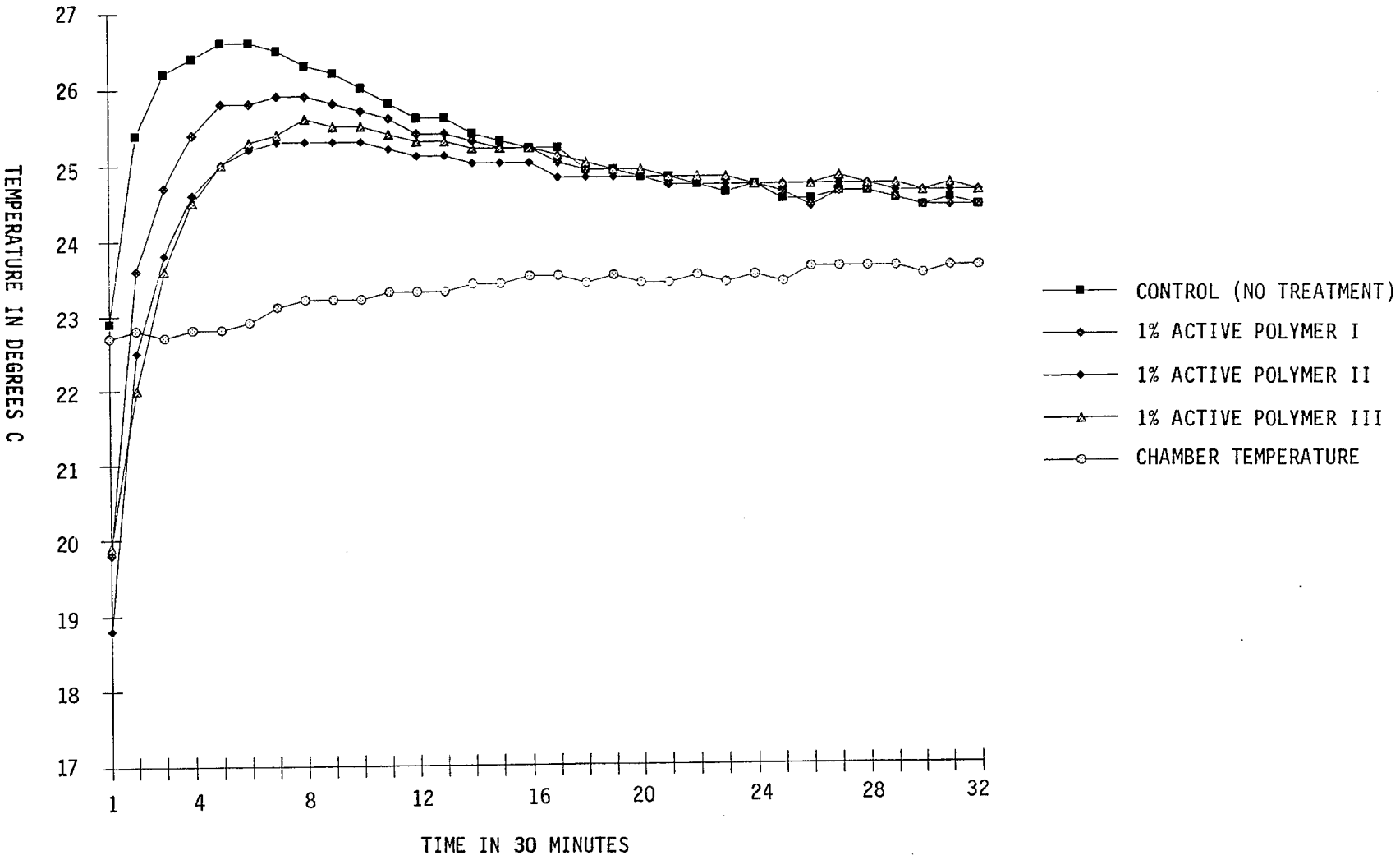
FIG. 1 is a graph of temperature within simulated coal piles versus time in 30 minute intervals.

The present invention relates to compositions and to a method for inhibiting coal oxidation. The coal oxidation inhibiting compositions of the present invention are comprised of aqueous solutions of water soluble cationic polymers. The preferred cationic polymers are diethylaminetriamine/adipic acid/epichlorohydrin polymers and aminomethylated polyacrylamide. The method of application is to include a polymer in an aqueous solution which is applied as a coating over the exterior surfaces of coal, in an amount effective to inhibit coal oxidation. In the preferred method the aqueous solution containing the cationic polymer contains an anionic foaming agent and is applied to coal as a foam.

DESCRIPTION OF THE PREFERRED EMBODIMENT

The coal oxidation inhibiting compositions of the present invention are aqueous solutions of water soluble cationic polymers. The polymers may be selected from a wide variety of water-soluble cationic polymers and may be either addition or condensation polymers. Most synthetic cationic polyelectrolytes are polyamine and polyquaternary ammonium salts, although non-nitrogen based cationic polymers are known. Polyamines and polyquaternary amines can be prepared by free-radical chain polymerization, epoxide addition reactions, condensation polymerization and reactions on polymer backbones. Polymers of this type are described in U.S. Pat. No. 4,426,409 to William J. Roe. Polyamines and polyquaternary anions are also discussed at pp. 489–507 of The Encyclopedia of Polymer Science and Engineering, Vol. 11, Sec. Ed. 1988.

The water soluble cationic polymers are preferably supplied as concentrates which are diluted by mixing with an aqueous solution. The treatment concentration of cationic polymer by weight in the aqueous solution can range from about 0.05% to about 20.0% and is preferably from about 0.1% to about 10.0%. The solution is preferably applied in an aqueous foam. However, the aqueous cationic polymer solutions could be effectively applied as a liquid spray providing adequate coal surface coverage is obtained. Cationic and amphoteric foaming agents can be used. Such foaming agents are available commercially. For example, EMCOL 6825 available from Witco Chemical Corporation. Cationic polymers generally cannot be foamed with anionic foaming agents due to the incompatibility of the cationic and anionic species in solution. However, certain cationic polymers, e.g., diethylenetriamine/adipic acid/epichlorohydrin polymers and aminomethylated polyacrylamide can be foamed with anionic foaming agents, e.g., a blend of sodium salts of C14–C16 alpha olefin sulfonate and alkyl ether sulfate. Exemplary commercial products are Bioterge AS-40 and Steol KS-460 available from Stepan Chemical Co. It is believed, therefore, that other anionic foaming agents may also be capable of foaming this and other cationic polymers. The concentration of foaming agent in the foam applied to coal on a weight percent basis can range from about 0.05% to about 5.0% and is preferably from about 0.1% to about 1.0%. Air is the preferred foam forming gas. Details of the foam forming process are well known in the art. Generally, foam may be produced as stated in U.S. Pat. No. 4,400,220 to Cole, Jr., which is incorporated herein by reference. Foam is applied at the rate of from about 0.5 to about 10 cubic feet of foam per ton of coal and preferably at the rate of about 1 to about 5 cubic feet per ton of coal.

The preferred compositions comprise from about 0.05 to about 20 weight percent water soluble cationic polymer, from about 0.05 to about 5 weight percent foaming agent and from about 75 to about 99.9 weight percent water. The molecular weight of the cationic polymers are preferably from about 100,000 to 5 million and most preferably from 300,000 to 2.5 million. The preferred polymers are diethylaminetriamine/adipic acid/epichlorohydrin polymers and aminomethylated polyacrylamide. The preferred foaming agents are sodium salts of C-14 to C-16 alpha olefin sulfonate and alkyl ether sulfates.

The present invention will now be described with respect to a number of specific examples which are to be regarded solely as illustrative and not as restricting the scope of the invention.

EXAMPLE I

Simulated coal piles were tested for oxidation by monitoring for elevated temperatures. Five samples of fresh coal were ground and moistened. The control sample was moistened with water and the four remaining samples were moistened with aqueous polymer solutions. The samples were placed in insulated containers, containing thermocouples, purged with $O_2$ and placed in an insulated chamber. Temperature measurements were taken of the internal coal sample temperature at 30 minute intervals. The results are shown in FIG. 1. FIG. 1 shows that the temperature was lowest for Polymer II which was an aminomethylated polyacrylamide with the next lowest for Polymer III which was a diethylaminetriamine/adipic acid/epichlorohydrin polymer. Polymer I, which was a polyvinyl alcohol formulation, also exhibited some oxidation inhibition, but did not keep sample temperatures as low as the two cationic polymers. The temperature declines shown in FIG. 1 were probably due to cessation of oxidation due to oxygen depletion in the sealed containers.

Thus, a composition comprising a water soluble cationic polymer and water effectively inhibits coal oxidation and thereby coal auto ignition when applied as a coating to coal surfaces.

EXAMPLE II

Six 1000 ton piles of coal originating from the Black Thunder mines in Cambell County, Wyoming were stacked outdoors. Piles No. 1 and 6 were control piles and were treated with a foamed, aqueous solution containing an anionic surfactant foaming agent comprising the sodium salts of C14 to C16 alpha olefin sulfonate and alkyl ether sulfate. Piles 2, 4 and 5 were treated with a foamed, aqueous solution containing the anionic surfactant foaming agent and a binder typically used for dust control. Pile 3 was treated with the anionic surfactant foaming agent and a diethylenetriamine/adipic acid/epichlorohydrin polymer. The treatment solution feed rates were about 0.35 gallons per ton of coal which produced about 1.5 $ft^3$ of foam per ton of coal. Coal oxidation inhibition was determined by measuring the internal coal pile temperature approximately one month following treatment. The feed rates of the binder concentrates are shown along with the temperature results in Table I.

TABLE I

| Coal Pile No. | Treatment | Binder Concentrate Feed Rate (gal/ton) | Internal Coal Pile Temperature (°F.) |
|---|---|---|---|
| 1 | None (control) | — | 99 |
| 2 | Sodium lignosulfonate | 0.028 | 96 |
| 3 | Cationic polyamine | 0.011 | 80 |
| 4 | Naphthenic oil | 0.028 | 86 |
| 5 | Ethylene glycol | 0.012 | 88 |
| 6 | None (control) | — | 94 |

Piles 4 and 5 had lower internal temperatures than the control pile but had higher internal temperatures than pile 3. The cationic polyamine used to treat pile 3 inhibited coal oxidation to the extent that pile 3 had an internal temperature from 14° to 19° F. below the untreated control piles 1 and 6 and treated pile 2. Pile 3 was also from 6° to 8° F. below piles 4 and 5 after approximately one month exposure to the same environmental conditions.

EXAMPLE III

Five 1000 ton test piles of coal were stacked outdoors. Each pile was treated with an aqueous foam comprising water and an anionic surfactant foaming agent comprising the sodium salts of alkyl ether sulfate and C14 to C16 alpha olefin sulfonate. Pile A was a control and was not treated with a binder. Piles B-D were treated with a foam containing equivalent amounts of binder normally utilized for dust suppression. Pile E was treated with a foam and a cationic polyamine comprising a diethylenetriamine/adipic acid/epichlorohydrin polymer. Approximately ½ gallon of foam solution was added per ton of coal which produced about 2 cubic feet of foam per ton of coal. Based on volume, the application ratio of foam to coal was 1:20 or 5%. The treatments are listed in Table II.

TABLE II

| Test Pile | Type |
|---|---|
| A | N/A |
| B | Polyvinyl alcohol |
| C | Naphthenic Oil |
| D | Sodium Lignosulfonate |
| E | Cationic Polyamine |

To measure the bulk temperature of the test piles a thermocouple probe was inserted into the coal piles. About 5–10 minutes were required for each temperature measurement. The pile temperatures measured over a three week period are plotted in FIGS. 2 and 3.

Figure 2:
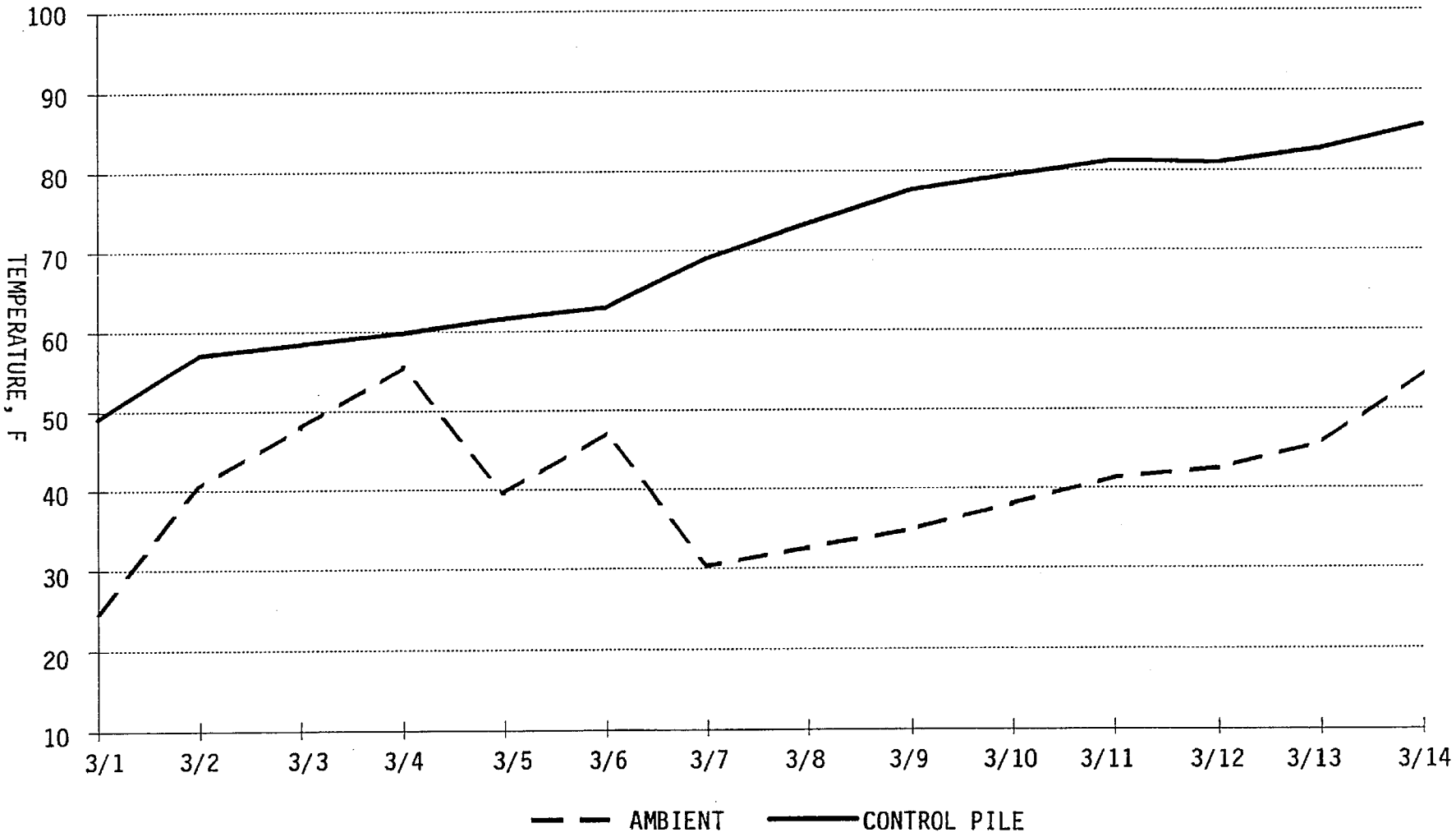
FIG. 2 is a graph showing the temperature in ° F. of the control pile of Example II over about a fourteen day period along with a graph of the daily average ambient air temperature over the same fourteen day period.

FIG. 2 shows the temperature profile of the control pile. The control pile temperature increased by 35° F. in two weeks. This corresponds to approximately 2.5° F./day. The rate of temperature increase was higher during the first week of the test (2.8° F./day) than the second week (2.4° F./day). Ambient temperatures ranged from 24°–55° F. over the test duration: Since all piles of coal tested were located in the same vicinity, it was assumed that the effect of ambient temperature on dissipation of heat from each pile was constant.

Table III shows the temperature changes of the test piles over the approximately two week test period.

TABLE III

| Test Pile | Week 1 °F./day | Week 2 °F./day |
|---|---|---|
| A | 2.8 | 2.4 |
| B | 3.2 | 2.0 |
| C | 2.7 | 2.4 |
| D | 1.6 | 3.8 |
| E | 1.7 | 2.6 |

Figure 3:
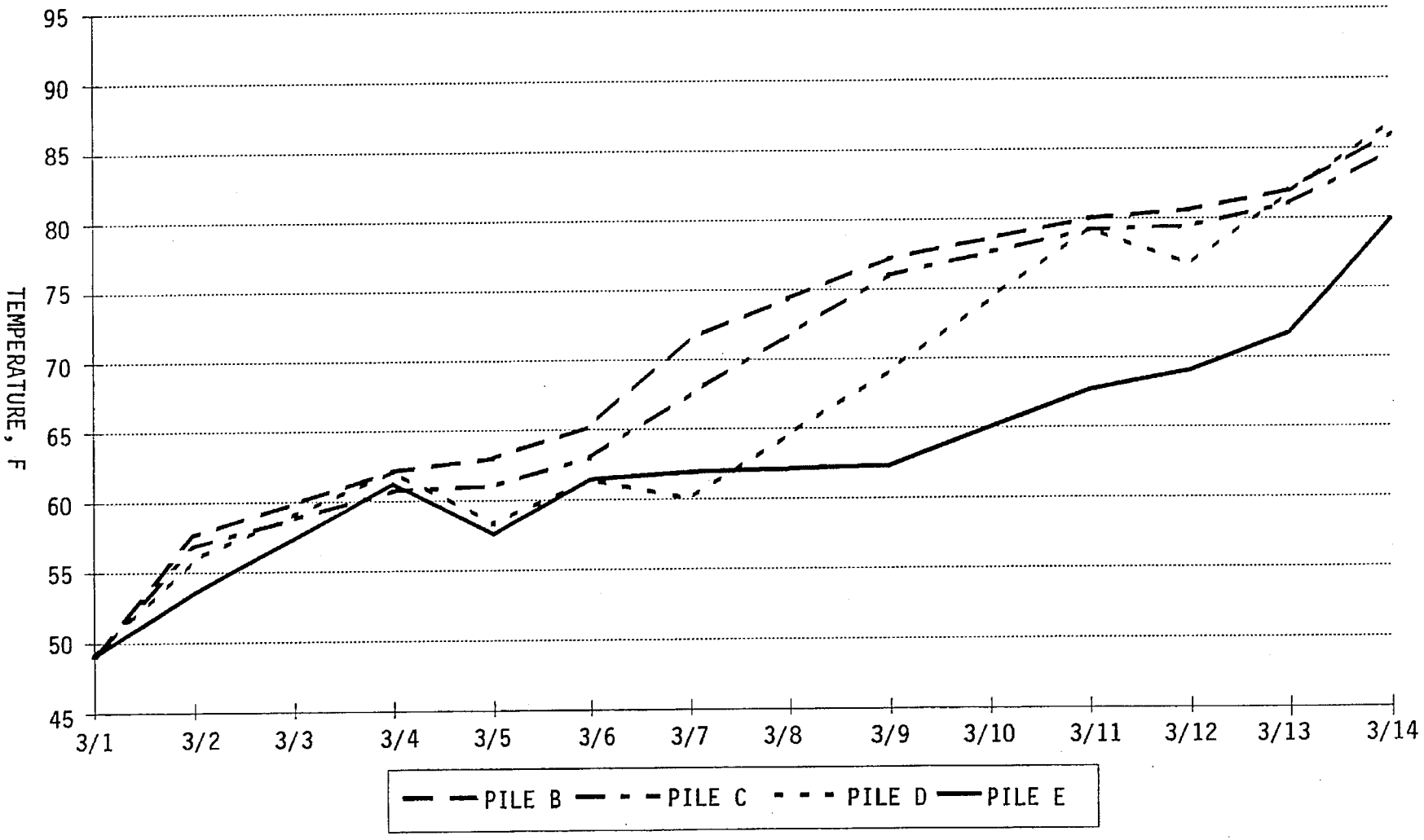
FIG. 3 is a graph of the temperature in ° F. of the treated piles of Example II over about a fourteen day period.

Only the coal pile E, treated with a water soluble cationic polymer, consistently had a temperature profile lower than the control pile as shown in FIG. 3.

The temperature profile of test pile E suggest that a cationic polymer coating on coal surfaces does not permanently alter the oxidation process but merely delays it. Thus, the amount of binder applied onto the surfaces controls the amount of oxidation inhibition which is obtained. Since coal oxidation is effected by a variety of factors including moisture content, ambient temperature, coal particle size, amorphous carbon content and the like, the amount of cationic polymer applied to a particular coal pile will be determined on an individual basis.

Thus a composition and a method of using the composition are provided which inhibits coal oxidation and thereby preserves the caloric heating value of coal and inhibits coal self ignition.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

I claim:

1. A method of inhibiting coal oxidation in a coal pile comprising coating all the surfaces of coal exposed to air with an oxidation inhibiting amount of a composition consisting essentially of a water soluble cationic polymer diluted in an aqueous solution.

2. The method of claim 1 wherein said composition is effective to inhibit coal self-ignition.

3. The method of claim 1 wherein said cationic polymer is diethylaminetriamine/adipic acid/epichlorohydrin polymer or aminomethylated polyacrylamide.

4. The method of claim 3 wherein from about 0.05 weight percent to about 20 weight percent of said composition is diethylaminetriamine/adipic acid/epichlorohydrin polymer or aminomethylated polyacrylamide and from about 75 weight percent to about 99.9 weight percent of said composition is water.

5. The method of claim 4 wherein said composition further comprises from about 0.05 to about 5 weight percent foaming agent.

6. The method of claim 5 wherein said foaming agent comprises a sodium salt of alkyl ether sulfates and C14 to C16 alpha olefin sulfonates.

7. The method of claim 6 wherein said composition is effective to inhibit coal self-ignition.

8. The method of claim 7 wherein said aqueous solution and said polymer are applied to said coal as a foam.

9. The method of claim 8 wherein said foam is applied to said coal in an amount of from about 0.5 $ft^3$ to about 10 $ft^3$ of foam per ton of coal.

* * * * *